US009970120B2

(12) United States Patent
Tomantschger et al.

(10) Patent No.: US 9,970,120 B2
(45) **Date of Patent: *May 15, 2018**

(54) POROUS, FLOW-THROUGH CONSUMABLE ANODES FOR USE IN SELECTIVE ELECTROPLATING

(71) Applicant: Integran Technologies Inc., Mississauga (CA)

(72) Inventors: Klaus Tomantschger, Mississauga (CA); Diana Facchini, Toronto (CA); Francisco Gonzalez, Toronto (CA); Jonathan McCrea, Toronto (CA); John Kratochwil, Aurora (CA); Dan Woloshyn, Toronto (CA); Yusuf Bismilla, Brampton (CA); Nandakumar Nagarajan, Burlington (CA); Mioara Neacsu, Maple (CA)

(73) Assignee: Integran Technologies Inc., Mississauga (CA)

( * ) Notice: Subject to any disclaimer, the term of this patent is extended or adjusted under 35 U.S.C. 154(b) by 304 days.

This patent is subject to a terminal disclaimer.

(21) Appl. No.: 14/997,636

(22) Filed: Jan. 18, 2016

(65) Prior Publication Data

US 2016/0130713 A1 May 12, 2016

Related U.S. Application Data

(63) Continuation of application No. 13/289,470, filed on Nov. 4, 2011, now Pat. No. 9,249,521.

(51) Int. Cl.
*C25D 5/06* (2006.01)
*C25D 5/08* (2006.01)
(Continued)

(52) U.S. Cl.
CPC ..... *C25D 5/06* (2013.01); *C25D 5/08* (2013.01); *C25D 5/18* (2013.01); *C25D 17/14* (2013.01); *C25D 1/00* (2013.01)

(58) Field of Classification Search
CPC ..... C25D 5/04–5/06; C25D 3/38–3/40; C25D 5/08
See application file for complete search history.

(56) References Cited

U.S. PATENT DOCUMENTS 2,643,221 A 6/1953 Brenner
2,662,211 A 12/1953 Marko
(Continued)

FOREIGN PATENT DOCUMENTS

CA 2562042 A1 6/2006
CN 101665968 A 3/2010
(Continued)

OTHER PUBLICATIONS

F. Mueller, "Pulse Plating & Other Myths", Plating & Surface Finishing, pp. 54-55, Apr. 2000.
(Continued)

*Primary Examiner* — Bryan D. Ripa
*Assistant Examiner* — Ho-Sung Chung
(74) *Attorney, Agent, or Firm* — Rankin, Hill & Clark LLP

(57) ABSTRACT

A method for electrodepositing a coating/free-standing layer on a workpiece in an electrolytic cell includes moving the workpiece and an anode applicator tool having a consumable anode insert relative to each other; anodically dissolving a metal from the insert and cathodically depositing the metal on the workpiece; providing flow of electrolyte solution through the insert to ensure that greater than 90% of the anodic reaction is represented by dissolution of the metal; recirculating collected electrolyte solution exiting the elec-
(Continued)

trolytic cell through the insert; applying an electric current to the electrolytic cell; maintaining a concentration of the anodically dissolved metal within ±25% of each Ampere-hour per liter of electroplating solution; and creating a cathodic electrodeposit on the workpiece which includes the anodically dissolved metal, the chemical composition of the deposit varying by less than 25% in the deposition direction over a selected thickness of up to 25 microns of the deposit.

19 Claims, 5 Drawing Sheets

(51) Int. Cl.

| | |
|---|---|
| ***C25D 17/14*** | (2006.01) |
| ***C25D 5/18*** | (2006.01) |
| *C25D 1/00* | (2006.01) |

(56) References Cited

U.S. PATENT DOCUMENTS

| | | | | |
|---|---|---|---|---|
| 2,961,395 | A | 11/1960 | Icxi | |
| 3,354,022 | A | 11/1967 | Dettre | |
| 3,779,887 | A | 12/1973 | Gildone | |
| 4,168,183 | A | 9/1979 | Greenfield | |
| 4,397,715 | A | 8/1983 | Mohan et al. | |
| 4,765,872 | A | 8/1988 | Hamano | |
| 4,931,150 | A | 6/1990 | Smith | |
| 5,358,547 | A | 10/1994 | Holko | |
| 5,409,593 | A | 4/1995 | Moskowitz | |
| 5,649,994 | A | 7/1997 | Holko | |
| 5,681,575 | A | 10/1997 | Burrel | |
| 5,733,684 | A | 3/1998 | Harada et al. | |
| 5,753,251 | A | 5/1998 | Burrel | |
| 5,863,410 | A | 1/1999 | Yates | |
| 5,872,074 | A | 2/1999 | Schultz | |
| 6,261,433 | B1 | 7/2001 | Landau | |
| 6,406,611 | B1 | 6/2002 | Engelhaupt | |
| 7,553,584 | B2 | 6/2009 | Chiang et al. | |
| 7,803,072 | B2 | 9/2010 | Palumbo | |
| 7,976,976 | B2 | 7/2011 | Tomantschger | |
| 8,022,004 | B2 | 9/2011 | Sandoval et al. | |
| 2001/0042690 | A1 | 11/2001 | Talieh | |
| 2003/0234181 | A1 | 12/2003 | Palumbo | |
| 2005/0031919 | A1 | 2/2005 | Ovshinsky et al. | |
| 2005/0170201 | A1 | 8/2005 | Ware | |
| 2005/0205425 | A1* | 9/2005 | Palumbo ..... | C25D 1/04 204/499 |
| 2007/0084731 | A1 | 4/2007 | Ware | |
| 2008/0314742 | A1 | 12/2008 | Tachibana | |
| 2009/0159451 | A1 | 6/2009 | Tomantschger | |
| 2010/0304172 | A1 | 12/2010 | Facchini et al. | |
| 2010/0304179 | A1 | 12/2010 | Facchini et al. | |
| 2010/0304182 | A1 | 12/2010 | Facchini et al. | |

FOREIGN PATENT DOCUMENTS

| | | | |
|---|---|---|---|
| EP | 2045368 | A1 | 4/2009 |
| KR | 100845744 | B | 7/2008 |

OTHER PUBLICATIONS

D. Gabe et al., "Protective Layered Electrodeposits", Electrochemica Acta, vol. 39, No. 8/9, pp. 1115-1121, 1994.

S.J. Bull et. al, "Multilayer Coatings for Improved Performance", Surface & Coating Technology 78 (1996) 173-184.

D. Facchini, J.L. McCrea, F. González, K. Tomantschger, and G. Palumbo, "Small Crystals, Big Benefits; Nanotech cobalt alloy coatings offer hard chrome alternative", Product Finishing, 73, 7, p. 14-18, Apr. 2009.

D. Facchini, J.L. McCrea, F. González, G. Palumbo, K. Tomantschger and U. Erb, "Nanostructured Metals and Alloys—Electrodeposited Nanostructured Cobalt Phosphorus Coatings as a Hard Chrome Alternative for Functional Applications", In: Jahrbuch Oberflächentechnik 64 2008: pp. 34-45.

B. Stein, A Practical Guide to Understanding, Measuring and Controlling Stress in Electroformed Metals, AESF Electroforming Symposium, Mar. 27-29, 1996, 1-6, Las Vegas, NV, USA.

Palumbo, G.; Gonzalez, F.; Tomantschger, K.; Erb, U.; Aust, K.T. "Nanotechnology Opportunities for Electroplating Industries" Plating and Surface Finishing, v 90, n 2, p. 36-45, Feb. 2003.

Kim, Simon H.; Erb, U.; Aust, K.T.; González, F.; Palumbo, G., "The corrosion behavior of nanocrystalline electrodeposits" Plating and Surface Finishing, v 91, n 5, p. 68-70, May 2004.

González, F.; McCrea, J.; Palumbo, G.; Erb, U., "Nanostructured Electrodeposited Cobalt: An Alternative to Hard Chromium", Bulletin-Cercle D Etudes Des Metaux Saint Etienne, 2004, vol. 17; Issue 9, pp. 27.

Karimpoor, A.A.; Erb, U.; Aust, K.T.; Palumbo, G. "High Strength Nanocrystalline Cobalt with High Tensile Ductility" Scripta Materialia, v 49, n 7, p. 651-6, Oct. 2003.

Karimpoor, A.A.; Erb, U.; Aust, K.T.; Wang, Z.; Palumbo, G., "Tensile Properties of Bulk Nanocrystalline Hexagonal Cobalt Electrodeposits" Materials Science Forum, v 386-388, p. 415-20, 2002.

Kim, S.H.; Aust, K.T.; Erb, U.; González, F.; Palumbo, G, "A Comparison of the Corrosion Behaviour of Polycrystalline and Nanocrystalline Cobalt" Scripta Materialia, v 48, n 9, p. 1379-84, May 2003.

Hibbard, G.; Aust, K.T.; Palumbo, G.; Erb, U. "Thermal Stability of Electrodeposited Nanocrystalline Cobalt" Scripta Materialia, v 44, n 3 p. 513-18, Mar. 16, 2001.

Osmola, D.; Renaud, E.; Erb, U.; Wong, L.; Palumbo, G.; Aust, K.T., "Synthesis of Nanocrystalline Co—W Alloys" Materials Research Society Symposium Proceedings, v 286, p. 191-196, 1993.

Hibbard, G.D.; Palumbo, G.; Aust, K.T.; Erb, U. "Nanoscale Combined Reactions: Non-Equilibrium α-Co Formation in Nanocrystalline & epsi;-Co by Abnormal Grain Growth" Philosophical Magazine, v 86, n 2, p. 125-39, Jan. 11, 2006.

Szpunar, Barbara; Aus, Martin; Cheung, Cedric; Erb, Uwe; Palumbo, Gino; Szpunar, Jerzy A; "Magnetism in Nanostructured Ni—P and Co—W Alloys" Journal of Magnetism and Magnetic Materials, v 187, n 3, p. 325-336, Sep. 1, 1998.

Hibbard, G.D.; Aust, K.T.; Erb, U.; "The Effect of Starting Nanostructure on the Thermal Stability of Electrodeposited Nanocrystalline Co" Acta Materialia, v 54, n 9, p. 2501-10, May 2006.

Karimpoor, A.A.; Erb, U.; "Mechanical Properties of Nanocrystalline Cobalt" Physica Status Solidi A, v 203, n 6, p. 1265-70, May 2006.

Karimpoor, A.A.; Aust, K.T.; Erb, U. "Charpy Impact Energy of Nanocrystalline and Polycrystalline Cobalt" Scripta Materialia, v 56, n 3, p. 201-4, Feb. 2007.

Hibbard, G.D.; Aust, K.T.; Erb, U.; "Thermal Stability of Electrodeposited Nanocrystalline Ni—Co Alloys" Materials Science and Engineering A, v 433, n 1-2, p. 195-202, Oct. 15, 2006.

Mohammadreza Baghbanan, Uwe Erb, Gino Palumbo "Towards the Application of Nanocrystalline Metals in MEMS" Physica Status Solidi (a), 203, 6, p. 1259-1264, 2006.

Eric W. Brooman, "Wear behavior of environmentally acceptable alternatives to chromium coatings: cobalt-based and other coatings" Metal Finishing, vol. 102, Issue 10, Oct. 2004, pp. 42-54.

M.A. Sheikholeslam, M.H. Enayati and K. Raeissi, "Characterization of nanocrystalline and amorphous cobalt-phosphorous electrodeposits" Materials Letters, vol. 62, Issues 21-22, Aug. 15, 2008, pp. 3629-3631.

Ms. Diana Facchini, Dr. Jonathan McCrea, Mr. Iain Brooks, Dr. Francisco Gonzalez, Dr. Gino Palumbo. "Electrodeposited Nanocrystalline Metals and Alloys as Environmentally Compliant Alternative Coatings to Functional Hexavalent Chromium and Cadmium" Aeromat 2009, Dayton OH, Jun. 9, 2009.

D. Facchini , N. Mahalanobis, F. Gonzalez, R. A. Prado, J. Benfer, K. Legg "Nanocrystalline Cobalt-Alloy Coatings for Chrome

(56) References Cited

OTHER PUBLICATIONS

Replacement Applications" SERDP/ESTCP Partners in Environmental Technology Symposium, Washington DC, Dec. 1-3, 2009.
D. Facchini, Dr. Jon McCrea, Dr. Francisco Gonzalez, Dr. Gino Palumbo Ruben Prado, Dr. Keith Legg "Nanocrystalline Cobalt-Alloy Coatings for Chrome Replacement Applications" SERDP/ESTCP Partners in Environmental Technology Symposium, Washington DC, Dec. 2-4, 2008.
D. Facchini, J.L. McCrea, F. Gonzalez, R. Prado, K. Legg and G. Palumbo "Nanocrystalline Cobalt-Alloy Coatings for Non-Line-of-Sight Chrome Replacement Applications" SERDP/ESTCP Partners in Environmental Technology Sumposium, Washington DC, Dec. 4-6, 2007.
Diana Facchini, Ruben Prado "Electrodeposition of Nanocrystalline Co—P Coatings as a Hard Chrome Alternative", ASETS Defense Meeting, Denver, Colorado, Sep. 2, 2009.
Diana Facchini, Ruben Prado, Keith Legg "Electrodeposited Nano Co—P: Coating Development and Technology Insertion at NADEP-JAX" Surface Finishing and Repair Issues for Sustaining New Military Aircraft, Phoenix, Arizona, Feb. 27, 2008.
Paco Gonzalez, "Dem-Val of Electrodeposited Nano Co—P Alloys for NLOS Coating Applications at NADEP Jacksoville" HCAT Meeting, San Diego, California, Jan. 25, 2006.
Paco Gonzalez, "Nanocrystalline CoP for Cr-Replacement", HCAT Meeting, Greensboro, North Carolina, Mar. 15-17, 2005.
Paco Gonzalez, "Nanocrystalline CoP for Cr-Replacement", HCAT Meeting, Park City, Utah, Jul. 20-21, 2004.
Jonathan L. McCrea, Paco Gonzalez, Doug Lee and Uwe Erb "Electroformed Nanocrystalline Coatings An Advanced Alternative to Hard-Chrome Electroplating PP-1152" HCAT Meeting, Cape Canaveral, Florida, Nov. 18-19, 2003.
Douglas E. Lee, Dr. Jonathan L. McCrea, Dr. Uwe Erb, "Electroformed Nanocrystalline Coatings An Advanced Alternative to Hard-Chrome Electroplating PP-1152" HCAT Meeting, San Diego, California, Apr. 2, 2003.
Dr. Maureen J. Psaila-Dombrowski, Douglas E. Lee, Dr. Jonathan L. McCrea, Dr. Uwe Erb, "Electroformed Nanocrystalline Coatings An Advanced Alternative to Hard-Chrome Electroplating PP-1152" Toronto, Ontario, Sep. 26, 2002.
Dr. Maureen J. Psaila-Dombrowski, Douglas E. Lee, Dr. Jonathan L. McCrea, Dr. Uwe Erb, "Electroformed Nanocrystalline Coatings An Advanced Alternative to Hard-Chrome Electroplating PP-1152" HCAT Meeting, Toronto, Ontario, Aug. 30, 2001.
Nihad Ben Salah,S. Beskri and J. Sapieha, "Development of nano-Co—P plating as a replacement for hard chrome for engine components", SERDP/ESTCP Workshop—Surface finishing and repair issues, Tempe, Az, Feb. 26-28, 2008.
Dr. E.W. Brooman, Mr. T.A. Naguy, Dr. M.L. Klingenberg, "Evaluation of Alternatives to Hard Chromium Coatings for Air Force Repair and Overhaul Applications", SUR/FIN 2007, Cleveland, OH, Aug. 13-16, 2007.
McCrea, J.L., Facchini, D., Gonzalez, F. and Palumbo, G., "Nanocrystalline Cobalt-Alloy Coatings for Non-Line-of-Sight Chrome Replacement Applications," in Proceedings of SUR/FIN 2007, Cleveland, OH (2007).
F.A. Lowenheim, Electroplating, McGraw-Hill Book Co., New York, 1978, pp. 152-155, 374-377.

* cited by examiner

POROUS, FLOW-THROUGH CONSUMABLE ANODES FOR USE IN SELECTIVE ELECTROPLATING

The present patent application is a continuation application of application Ser. No. 13/289,470, filed Nov. 4, 2011.

FIELD OF THE INVENTION

Exemplary embodiments herein relate to the selective plating/brush plating of coatings or free-standing components employing non-stationary, consumable anodes. The inventive anode inserts are perforated/porous to provide relatively unimpeded electrolyte flow and comprise the consumable anode material in high surface area to reduce the effective local anodic current density. During electroplating, sufficient electrolyte is pumped through the consumable anodes at sufficient flow rates to minimize or avoid the generation of chlorine and/or oxygen gas and/or undesired reaction such as the anodic oxidation of phosphorus-bearing ions in the electrolyte. According to one embodiment, the consumable anode material has a microstructure which is fine-grained and/or amorphous.

BACKGROUND OF THE INVENTION

Electrodeposited metallic coatings applied by selective and/or brush plating are extensively used in consumer and industrial applications. In brush plating, dimensionally stable anodes (DSA) made of graphitic materials are commonly used. However, in the case of electrolytes that contain ions that can be oxidized (such as chlorides, phosphorus-bearing ions, or metal ions with multiple valence states), significant challenges are encountered leading to (i) undesired chlorine gas evolution posing health and safety risks, (ii) a rapid deterioration of the electrolyte, and (iii) the inability to maintain a constant coating composition with increasing deposition time. These problems may be caused by anodic reactions, including but not limited to the oxidation of hypophosphorous or phosphorous ions to phosphoric ions, chloride to chlorine, $Fe^{2+}$ to $Fe^{3+}$, and water to oxygen gas.

It is well documented that DSAs and consumable anodes (SAs) are used in electrodeposition. Where feasible, e.g., in tank, drum and barrel plating, consumable anodes containing the metal or an alloy of the elements cathodically deposited are frequently used. In this case metal chips, rounds or pieces are usually filled into suitable anode cages made of inert materials such as titanium baskets. In contrast DSAs are used in commercial brush-plating applications.

Prior art specific to selective plating includes the disclosure of brush or tampon plating tools employing "anode brushes" which are wrapped in an absorbent tool cover material or felt. The brush is rubbed over the surface to be plated and electrolyte solution is injected into tool such that it must contact the anode and pass through the absorbent tool cover material. Typical anodes are made of graphite and serve as dimensionally stable anodes (DSAs), i.e., apart from corrosion or undesired mechanical degradation, these anodes are not consumed during the plating process and do not liberate metal ions used for the cathodic deposition.

In brush electroplating consumable anodes, which contain the very metal/alloy to be plated and replenish the cathodically reduced/deposited metal ions via anodic dissolution, are not used. Reasons include added complexity due to size/shape changes associated with consumable anodes and the confined geometry of the "electrolytic cell".

Icxi in U.S. Pat. No. 2,961,395 discloses a process for electroplating an article without the necessity to immerse the surface being treated into a plating tank. The hand-manipulated applicator serves as an anode and applies chemical solutions to the metal surface of the workpiece to be plated. The active anode is made of carbon. The workpiece to be plated serves as a cathode. The hand applicator anode with the wick containing the electrolyte and the workpiece cathode are connected to a DC power source to generate a metal coating on the workpiece by passing a DC current.

Smith in U.S. Pat. No. 4,931,150 discloses a selective electroplating apparatus for rapidly depositing a metal onto a selected surface of a workpiece employing conformal consumable or non-consumable anodes.

Moskowitz in U.S. Pat. No. 5,409,593 discloses a device for brush electroplating a surface of a workpiece using a consumable anode. The anode is selectively retained within a cavity formed in a lower surface of a carrier piece composed of a generally electrically non-conductive material. The lower surface of the carrier piece is shaped to conform to at least a portion of the surface of the workpiece. An absorbent material extends over the lower surface of the carrier piece to form a brush. The cover material and lower surface of the anode are spaced from each other to form an electrolyte chamber. The device also includes an assembly that is fluidly connected to the inter-electrode gap to inject a flow of the electrolyte into the chamber. The metal anode plate insert can be mechanically readjusted/lowered in the anode tool (to account for increasing anode depletion).

Many commercial electrolytes contain chloride ions (e.g., Watts bath for Ni and/or Co). On graphite or other active anode materials that are typically employed in brush plating, chlorine is anodically evolved in addition to or instead of oxygen. A number of industrially popular metallic coatings include phosphorus as an alloying element which poses significant bath management challenges and coating composition uniformity issues when using DSAs. Other electrolytes contain metal-ions that can be anodically oxidized when employing non-consumable anodes resulting in difficulties, e.g., the $Fe^{2+}/Fe^{3+}$ reaction in Fe containing electrolytes. The prior art is rich in the use of P-bearing electrodeposited coatings comprising Ni-, Co-, and/or Fe-based alloy coatings.

Brenner in U.S. Pat. No. 2,643,221 discloses the electrodeposition of Ni—P (with up to 15% P) and Co—P (up to 10% P) alloy coatings from solutions containing the metal ions, chlorides, and phosphoric and phosphorous acid. Brenner is silent on the use of selective and brush plating.

Engelhaupt in U.S. Pat. No. 6,406,611 describes electrodeposited Ni or Co alloys with $2^{at.}$% to $25^{at.}$% P alloys having low-stress from sulfate electrolytes containing phosphorous acid and using consumable or insoluble anodes. Engelhaupt is silent on the use of selective and brush plating.

Ware in US 2005/0170201 and US 2007/0084731 describes coarse-grained Co—P—B coatings of low compressive residual stress and improved fatigue resistance using soluble or insoluble noble metal anodes and an electrolyte containing, among other, chloride, sulfate and phosphorous ions. Ware is silent on the use of selective and brush plating.

Palumbo in US 2005/0205425 and DE 10228323, assigned to the same assignee as the present application, discloses a process for forming coatings or freestanding deposits of nanocrystalline metals, metal alloys or metal matrix composites. The process employs tank, drum plating or selective plating processes including brush plating using aqueous electrolytes and optionally a non-stationary anode or cathode. Nanocrystalline metal matrix composites are disclosed as well. Palumbo teaches that the electrolyte flow rate normalized for electrode area can be used to control the microstructure of the cathodic deposit. Specifically, grain refinement is achieved above critical normalized agitation rates.

Palumbo in US 2003/0234181, assigned to the same assignee as the present application, discloses a process for electroforming in situ a structural reinforcing layer of selected metallic material for repairing an external surface area of a degraded section of metallic workpieces. A suitable apparatus is assembled on or near the degraded site and is sealed in place to form the plating cell. Also described is a process for plating "patches" onto degraded areas by selective plating including brush plating.

Facchini in US 2010/0304172, US 2010/0304179 and US 2010/0304182 describes the electrodeposition of coatings or free-standing components comprised of Co-bearing metallic materials, including Co—P, that possess a fine-grained and/or amorphous microstructure with improved fatigue performance using soluble or dimensionally stable anodes and tank, drum, barrel and brush plating.

Hamano in U.S. Pat. No. 4,765,872 describes a method for treating a plating solution containg $Fe^{3+}$ ions in a separate electrolytic cell having a cathode compartment and an anode compartment partitioned by an ion-exchange membrane. Plating solution containing up to 10 g/l of $Fe^{3+}$ ions is pumped into the cathode compartment, an electrically conductive solution is provided to the anode compartment, and $Fe^{3+}$ ions are electrolytically reduced in the plating solution to $Fe^{2+}$ ions using a cathode having a hydrogen overvoltage of not higher than 350 mV, preferably made of a carbon material.

SUMMARY OF THE INVENTION

The present disclosure relates to consumable anode inserts, e.g., for anode applicators to be used in selective electroplating devices, particularly suitable for chloride-, bromide- or iodide-containing electrolytes.

The present disclosure relates to consumable anode inserts, e.g., for anode applicators to be used in selective electroplating devices, for cathodically depositing P-bearing metallic layers, coatings or patches.

The present disclosure relates to consumable anode inserts for anodes for use with plating solutions containing metal-ions that can be anodically oxidized to higher valence states, including, but not limited to Au, Bi, Cr, Fe, Ir, Pb, Pd, Pt, Sb, Sn and V.

It is an objective of the present disclosure to provide consumable anode applicators that are intended for use in selective and/or electroplating apparatus and that are capable of sustaining high anodic metal dissolution current densities at electrochemical potentials well below their respective ion-oxidation, oxygen evolution and/or chlorine evolution potential in the same electrolyte under the same conditions.

It is an objective of the present disclosure to provide metal-bearing consumable anode inserts, e.g., for selective plating anodes such as anode brushes, that contain at least one of the metals to be deposited cathodically in the form of an electrolyte pervious layer or coating on a non-conductive permanent substrate.

It is an objective of the present disclosure to provide metal-bearing consumable anode inserts for selective plating anode assemblies that contain no carbon and/or graphite near the anode-workpiece interface which could serve as a reaction site for undesired side reactions including, but not limited to water, chloride and P-ion oxidation.

It is an objective of the present disclosure to provide consumable metal or alloy anode inserts that are suitably perforated or porous (i) to provide for sufficient electrolyte flow through the consumable anode structure and (ii) to increase the total active anode surface area, i.e., the effective consumable anode area is greater than the geometric electrode interface area between the anode and the work-piece.

It is an objective of the present disclosure to provide consumable anode inserts that have an outer surface that is accessible to and wetted by the electrolyte and that is at least 10%, preferably at least 50% and even more preferably at least 100% greater than the geometric electrode interface area between the anode and the work-piece to be plated.

It is an objective of the present disclosure to provide consumable anode inserts that are porous or suitably perforated structures to allow for electrolyte flow through the inserts, with a porosity of least 1%, preferably at least 5% and even more preferably at least 10%.

It is an objective of the present disclosure to provide consumable anode inserts capable of sustaining an electrolyte flow through the active anode structure or cross-section which is at least 1 ml/min, preferably at least 5 ml/min and even more preferably at least 10 ml/min and an applied average cell current expressed in Ampere ($A_{av}$), or, in the case of pulse plating, forward peak current in Ampere ($A_{peak}$).

It is an objective of the present disclosure to provide consumable anode inserts that are capable of sustaining an electrolyte flow through the active anode structure or cross-section which, normalized by $cm^2$ geometrical electrode interface anode area, is at least 0.01 ml/(min per $cm^2$ interfacial area), preferably at least 0.5 ml/(min·$cm^2$ interfacial area) and even more preferably at least 5 ml/(min·$cm^2$ interfacial area). It is a further objective to provide an electrolyte flow through the consumable anode insert of ≥1 ml/(min·$A_{av}$), preferably ≥10 ml/(min·$A_{av}$) and more preferably ≥20 ml/(min·$A_{av}$).

It is an objective of the present disclosure to provide consumable anode inserts capable of sustaining an electrolyte flow through the active anode structure or cross-section which have a permeability of $\geq 10^8$ millidarcy (mD).

It is an objective of the present disclosure to provide consumable anodes for use in a selective electroplating apparatus capable of maintaining the concentration of the anode metal or metals ions in solution relatively constant and maintain the cathodic deposit composition relatively constant with increased plating time and/or Ah/l of electrolyte use.

It is an objective of the present disclosure to provide consumable anode inserts comprising at least one metal to be anodically dissolved and cathodically deposited, that are made from a single, coherent active anode structure and that do not consist of loose flakes, chips, plates, powders or metal rounds that, with extended use and dissolution, reduce in size, lose electrical contact with each other and are prone to plug the absorber impeding electrolyte flow and/or short the anode against the work-piece by releasing small particulates that are trapped in the absorber or anode pieces piercing the absorber. The present disclosure contemplates using distinct coherent anode structures for more than one metal/alloy incorporated into and integrated with the consumable anode.

It is an objective of the present disclosure to provide consumable anodes for use in a selective electroplating apparatus wherein the consumable anode material has a microstructure which is fine-grained and/or amorphous to provide for uniform anodic dissolution.

It is an objective of the present disclosure to provide consumable anodes for use in selective electroplating systems wherein the consumable anode material forms a layer on an inert substrate. The employ of the inert substrate avoids the structural disintegration of the effective consumable anode, insures unimpeded electrolyte flow through the anode insert at all times and prevents release of powders/flakes/anode fragments which could plug the anode insert or the absorber or could cause a short between the anode and the workpiece.

It is an objective of the present disclosure to provide consumable anodes for use in a selective electroplating apparatus capable of operating at low internal-resistance-free (IRF) cell voltages, low applied cell voltages and low anode potentials.

It is a further objective of the present disclosure to provide consumable anodes that are intended for use in a selective electroplating apparatus and that are capable of eliminating environmental and worker safety issues inherent to dimensionally stable anodes (DSAs), which are prone to chlorine evolution when used with chloride-containing electrolytes.

It is another objective of the present disclosure to provide consumable anodes for use in a selective electroplating apparatus for depositing P-containing coatings comprising at least one metal selected from the group consisting of Ni, Co, Fe and Zn.

It is another objective of the present disclosure to provide consumable anodes for use in a selective electroplating apparatus which provides for a convenient detection of exhaustion of the active consumable anode material by a commensurate rise of the cell voltage and anode potential.

It is another objective of the present disclosure to provide consumable anode inserts for use in a selective electroplating apparatus wherein the anodic active metal or alloys are applied to suitable permanent substrates by electrodeposition, electroless deposition, electrophoresis and/or physical or chemical vapor deposition.

It is another objective of the present disclosure to provide consumable anode inserts for use in selective electroplating applicators to apply metallic coatings, layers and/or patches selected from the group of amorphous and/or fine-grained metals, metal alloys or metal matrix composites to at least part of the surface of a suitable workpiece or substrate by electrodeposition. The coating process can be applied to new parts and/or can be employed as a repair/refurbishment technique.

It is an objective of the present disclosure to provide consumable anode inserts for use in selective electroplating applicators which can operate at significantly high current densities to enable, e.g., the cathodic electrodeposition of fine-grained metallic coatings/layers with an average grain size between 2 nm and 5,000 nm and/or amorphous coatings/layers and/or metal matrix composite coatings. Optionally, graded and/or layered structures can be cathodically deposited using the consumable anode applicator.

It is an objective of the present invention to provide readily interchangeable consumable anode inserts for use in selective electroplating applicators that can be easily and conveniently replaced when exhausted or when using the same plating hardware for plating different metals or alloys.

It is an objective of the present invention to provide selective electroplating applicators to be used as flow-through anodes in an electrochemical cell for cathodically depositing a metallic layer or coating optionally containing solid particulates dispersed therein.

It is another objective of the present disclosure to provide consumable anode inserts for use in selective electroplating applicators to be used in applications requiring a cathodic deposit property, e.g, the chemical composition, varying by less than $25^{wt}\%$, preferably less than $10^{wt}\%$, in the deposition direction over a selected thickness in a layer height direction of up to 25 microns, preferably up to 100 microns, and more preferably up to 250 microns, the selected thickness being a portion of the overall deposit thickness, i.e., the overall layer height direction.

It is another objective of the present invention to provide consumable anode inserts for use in a selective electroplating apparatus to be used in electroplating applications employing DC plating or pulse electrodeposition including reverse pulsing, as well as other current or voltage modulations with time to enable the deposition of "layered structures" and/or "graded structures", e.g., by conveniently modulating the applied potential, current density or both, to generate cathodic deposits with at least one microstructure selected from the group consisting of coarse-grained, fine grained and amorphous microstructures as well as graded or layered structures with the cathodic sublayer thickness ranging from 1.5 nm to 1,000 microns.

It is another objective of the present disclosure to provide consumable anode inserts for use in selective electroplating comprising "multifunctional anodes" such as "dual anodes", e.g., electrically isolated rows or sections of one metal or alloy layer and at least a second metal or alloy layer, enabling each anode to be powered by a separate power supply to tailor the extent of dissolution of each anode material. Preferably, these multi-functional anodes are all incorporated in a single active anode insert and have their own electrical contacts to enable the control of the individual anodic currents of each specific metal or alloy layer.

It is another objective of the present disclosure to provide consumable anode inserts for use in selective electroplating comprising "compositionally graded and/or layered" active anode materials to enable the convenient cathodic deposition of graded and/or layered structures without unnecessarily complicating bath management.

According to one aspect, a consumable anode applicator to electrodeposit selectively a coating onto a workpiece comprises:

an applicator housing containing at least one consumable anode insert;

a fluid connection for the flow of an electrolyte solution through the consumable anode insert;

an electrical connection for supplying current from a power supply to the consumable anode insert;

the consumable anode insert including:

- a permanent substrate which is electrochemically inert and electrolyte pervious,
- a sacrificial anode metallic coating/layer provided on the permanent substrate and having a thickness between 1 micron and 5 cm, the sacrificial anode metallic coating/layer being an active consumable anode material capable of being anodically dissolved when current is supplied to the electrical connection; and an electrically non-conductive, electrolyte-pervious absorber positioned between and in intimate contact with both the consumable anode insert and the workpiece;

wherein an electrolyte flow rate through the consumable anode insert and the absorber is one of at least 1 ml/min per applied Ampere average anodic current or peak anodic current and at least 1 ml/(min×$cm^2$ interfacial area).

According to another aspect, a consumable anode applicator to electrodeposit selectively a coating onto a workpiece comprises:

an applicator housing containing at least one consumable anode insert;

a fluid connection for the flow of an electrolyte solution through the consumable anode insert;

an electrical connection for supplying current from a power supply to the consumable anode insert;

the consumable anode insert being pervious to the electrolyte and containing a sacrificial anode metallic material, the sacrificial anode metallic material being capable of being anodically dissolved when current is supplied to the electrical connection; and an electrically non-conductive, electrolyte pervious absorber positioned between and in intimate contact with the consumable anode insert and the workpiece;

wherein an electrolyte flow rate through the consumable anode insert and the absorber is one of at least 1 ml/min per applied Ampere average anodic current or peak anodic current and at least 1 ml/(min×$cm^2$) interfacial area.

According to another aspect, a method for selectively electrodepositing a coating or a free-standing layer on a workpiece in an electrolytic cell comprises:

moving the workpiece to be coated and an anode applicator tool relative to each other during the electrodeposition process, the anode applicator tool including a consumable active anode insert;

anodically dissolving a metal from the consumable anode insert and cathodically depositing the metal on the workpiece;

providing flow of electrolyte solution through the consumable anode insert to ensure that greater than 90% of the anodic reaction is represented by dissolution of the metal;

collecting the electrolyte solution exiting the electrolytic cell and recirculating the collected electrolyte solution through the consumable anode insert;

applying an electric current having a duty cycle between 5% and 100% to the electrolytic cell;

maintaining a concentration of the metal being anodically dissolved from the consumable anode insert in the electrolyte solution within ±25% for each Ampere-hour (Ah) per liter of electroplating solution; and creating a cathodic deposit on the workpiece which includes the metal anodically dissolved from the consumable anode insert, the chemical composition of the deposit varying by less than $25^{wt}$% in the deposition direction over a selected thickness of up to 25 microns, the selected thickness being a portion of the overall deposit thickness in deposition direction.

Definitions

As used herein, the term "plating cell" or "electroplating cell" means an electroplating apparatus comprising at least one workpiece and at least one anode separated by an ionically conductive electrolyte and means for providing electrical power to at least one workpiece and at least one anode and a fluid circulation loop optionally containing a filter and heater to supply electrolyte to, and remove electrolyte from, the plating cell.

As used herein, the term "selective plating" means an electroplating process whereby not the entire surface of the workpiece is coated.

In this context, the term "brush plating" or "tampon plating" is defined as a portable method of selectively plating localized areas of a workpiece without submersing the article into a plating tank. Selective plating techniques are particularly suited for repairing or refurbishing articles, as brush plating set-ups are portable, easy to operate and do not require the disassembly of the system containing the workpiece to be plated. Brush plating also allows plating of parts that are too large for immersion into plating tanks.

As used herein, the term "soluble anode" or "consumable anode" (SA) means a positive electrode that is intended for use in an electroplating cell in which at least one solid metal is oxidized to form a metal-ion that is released into and dissolves in the electrolyte when an electric current passes through the cell it is employed in.

As used herein, the term "non-soluble anode", "non-consumable anode" and "dimensionally-stable anode" (DSA) means a positive electrode for use in an electroplating cell which provides sites for the anodic reaction of species present in the electrolyte without being dissolved or consumed itself (apart from unavoidable corrosion). Examples of DSAs include noble metal or carbon/graphite based electrodes and typical anodic reactions using DSAs encountered in aqueous electrolytes include oxygen evolution, in presence of chloride ions in the electrolyte, chlorine evolution, and/or oxidation of other ions present in the electrolyte.

As used herein, the term "dimensionally-stable soluble anode" (DSSA) or "dimensionally-stable consumable anode" means a positive electrode for use in an electroplating cell where the consumable anode material is not provided in loose form but in a coherent way such as on a permanent inert substrate to minimize or altogether avoid the release of particulates from the anode structure upon increased use. Dimensionally-stable consumable anodes preferably do not disintegrate with extended active anode material(s) consumption.

As used herein, the term "soluble/consumble active anode material" means the metallic material(s) oxidized on the positive electrode to form ions which dissolve in the electrolyte and cathodically deposit on the workpiece. The soluble/consumable active anode material can be a layer on an inert/permanent substrate to provide for a soluble/consumable anode which, while being dissolved during anodic oxidation, retains its structural integrity, i.e., the disintegration of the soluble/consumable anode is avoided.

As used herein, the term "electrochemically active anode structure" means the effective anode surface wetted by the electrolyte where the anodic reaction physically takes place. The electrochemically active anode structure can be a metal/alloy layer that anodically dissolves during electrodeposition and/or the dimensionally stable soluble anode surface at which ionic species present in the electrolyte are oxidized. As is described herein, under certain conditions the electrochemically active anode structure can simultaneously provide consumable anode sites and the electrode surface for anodically oxidizing anodic species present in the electrolytic cell and accessible to the electrochemically active anode structure.

As used herein, the term "electrode interface area" or "interfacial area" means the geometric area created between the cathode and the anode where electrochemical reactions and mass transport take place and which is used to, e.g., determine the applied current density expressed in mA/$cm^2$ or the electrolyte circulation speed through the active anode expressed in 1/min and $cm^2$.

As used herein, the term "bath management" means monitoring and taking corrective action of the electrolyte "bath" being employed in an electroplating operation, including, but not limited to: concentration of metal ion(s), additives, byproducts; pH; temperature; impurities; and particulates.

As used herein, the terms "metal", "alloy" or "metallic material" mean crystalline and/or amorphous structures where atoms are chemically bonded to each other and in which mobile valence electrons are shared among atoms. Metals and alloys are electronic conductors; they are malleable and lustrous materials and typically form positive ions. Metallic materials include Ni—P, Co—P, Fe—P.

As used herein, the terms "metal-coated article", "laminate article" and "metal-clad article" mean an item which contains at least one permanent substrate material and at least one metallic layer or patch covering at least part of the surface of the substrate material. In addition, one or more intermediate structures, such as metalizing layers and polymer layers including adhesive layers, can be employed between the metallic layer and the substrate material.

As used herein the term "laminate" or "nanolaminate" means a metallic coating that includes a plurality of adjacent metallic layers that each has an individual layer thickness between 1.5 nm and 1 micron. A "layer" means a single thickness of a substance where the substance may be defined by a distinct composition, microstructure, phase, grain size, physical property, chemical property or combinations thereof. It should be appreciated that the interface between adjacent layers may not be necessarily discrete but may be blended, i.e., the adjacent layers may gradually transition from one of the adjacent layers to the other of the adjacent layers.

As used herein, the term "metallic coating" or "metallic layer" means a metallic deposit/layer applied to part of or the entire exposed surface of an article. The substantially metallic coating is intended to adhere to the surface of the article to provide mechanical strength, or, in the case of consumable anodes, a source of the metal or alloy to be anodically dissolved.

As used herein, the term "metal matrix composite" (MMC) is defined as particulate matter embedded in a metal matrix. MMCs are produced by suspending particles in a suitable plating bath and incorporating particulate matter into the deposit by inclusion. Alternatively, MMCs can be formed by electroplating porous structures including foams, felts, clothes, perforated plates and the like.

As used herein, the term "coating thickness" or "layer thickness" refers to depth in a deposit direction.

As used herein, "exposed surface" refers to all accessible surface area of an object accessible to a liquid. The "exposed surface area" refers to the summation of all the areas of an article accessible to a liquid.

As used herein "permeability" or "hydraulic permeability" in fluid mechanics is a measure of the ability of a porous material to allow fluids to pass through it expressed in $m^2$ or millidarcy (mD) (1 darcy$\approx 10^{-12}$ $m^2$). (highly fractured rock$>10^8$ millidarcy).

According to one aspect of the present disclosure, an electroplating apparatus is provided for a process which comprises the steps of: positioning the anode applicator containing at least one consumable anode insert and the absorber on the metallic or metalized workpiece to be plated; connecting a suitable fluid circulation system providing for pumping electrolyte into the anode applicator and through at least one consumable anode insert; providing electrolyte to the workpiece at least in the area to be plated and collecting the electrolyte exiting the workpiece to be suitably re-circulated to the anode applicator; providing electrical connections to the workpiece (permanent substrate) or temporary cathode to be plated and to one or more consumable anode inserts; and plating a metallic material on the surface of the metallic or metalized workpiece using suitable direct current (D.C.) or pulse electrodeposition. In addition to selective plating applications it is feasible to employ the anode applicator in tank drum-plating and barrel-plating applications where it is desired/required to pump electrolyte through the consumable anode structure.

As outlined above, however, the anode applicator according to this disclosure, is particularly suited for use in selective plating applications requiring the coating of selected areas of the article only, without the need to coat the entire article.

According to this invention metallic patches or sleeves cathodically deposited using the anode applicator are not necessarily uniform in thickness, microstructure and composition and can be deposited in order to, e.g., enable a thicker coating on selected sections or sections particularly prone to heavy use, erosion or wear.

The following listing further defines the article of the invention:

Flow-Through Consumable-Anode Substrate:

Suitable substrates serving as carrier for the consumable anode material(s) include metallic materials which preferably do not anodically dissolve in the electrolyte such as noble metals. Suitable substrates can also include non-metallic materials including, but not limited to, ceramics and polymers. Carbon-based or carbon-containing materials are undesired for use in areas and on anode applicator parts that can become active anode sites, in particular for use in electrolyte containing chloride ions. Suitable substrate geometries include open cell foams, meshes, perforated plates and the like which provide a relative unimpeded electrolyte flow through the consumable anode insert.

Consumable Anode Active Material Layer:

| Composition: | metallic material which can be anodically dissolved in the electrolyte (Ag, Cd, Co, Cu, Fe, Ni, Pb, Sn, Zn,) optionally containing particulates |
|---|---|
| Microstructure: | Amorphous or crystalline |
| Minimum average grain size [nm]: | 2; 5; 10 |
| Maximum average grain size [μm]: | 0.1; 0.5; 1; 5; 100 |
| Metallic Layer Thickness Minimum [μm]: | 5; 10; 25; 30; 50; 100 |
| Metallic Layer Thickness Maximum [mm]: | 2.5; 25; 50 |
| Minimum Porosity [%]: | 0; 1; 5; 10; 15; 20; 25; 50 |
| Maximum Porosity [%]: | 55; 75; 95, 99 |

Electrodeposition Specification:

| | |
|---|---|
| Minimum Deposition Rates [mm/hr]: | 0.025; 0.05; 0.1 |
| Maximum Deposition Rates [mm/hr]: | 0.5; 1; 2 |
| Minimum Flow Rates Through the Consumable Anode Insert [ml/(min × $cm^2$ anode interfacial area)]: | 0.01; 0.1 |
| Maximum Flow Rates Through the Consumable Anode Insert [ml/(min × $cm^2$ anode interfacial area)]: | 7.5; 10 |
| Minimum Flow Rates Through the Consumable Anode Insert [ml/(min × applied average or peak Ampere)]: | 1; 0.1 |
| Maximum Flow Rates Through the Consumable Anode Insert [ml/(min × applied average or peak Ampere)]: | 7.5; 10 |

BRIEF DESCRIPTION OF THE DRAWINGS

In order to better illustrate the present disclosure by way of examples, descriptions are provided for suitable embodiments of the method/process/apparatus according to the present disclosure in which.

DETAILED DESCRIPTION

Figure 1:
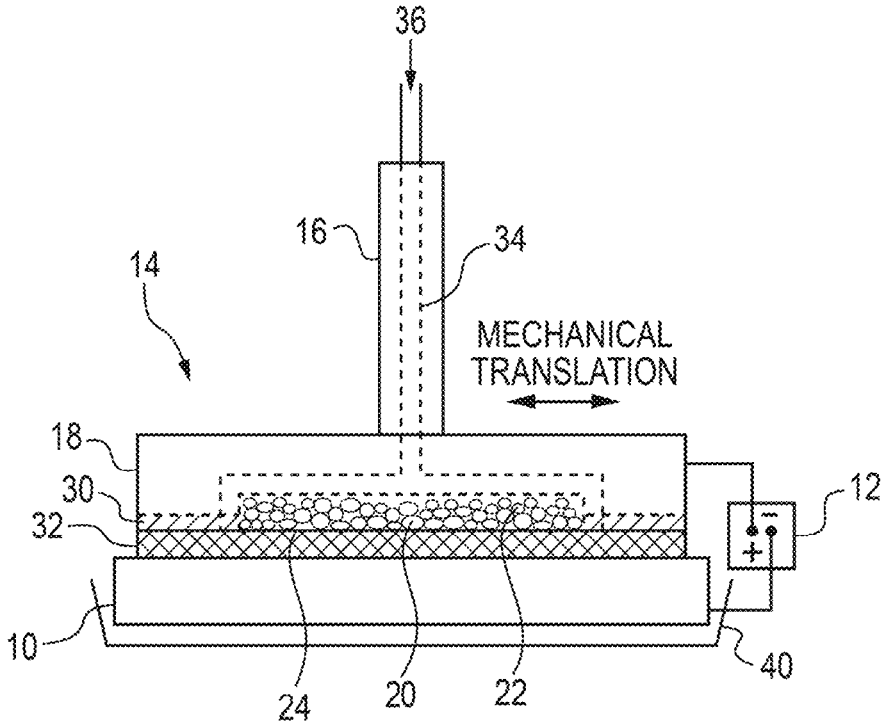
FIG. 1 illustrates an exemplary embodiment of the anode applicator tool.

The present disclosure relates to selective plating/brush plating applicators employing dimensionally stable flow-through soluble/consumable-anodes (DSSA) for use in electroplating at high deposition rates. The novel consumable anode inserts employed are perforated/porous, do not disintegrate with increased active material consumption, and comprise a surface area greater than the geometric interfacial anode/cathode. During electroplating, electrolyte is pumped through the soluble anode inserts at a sufficient flow rate to enable the anodic dissolution of the consumable anode active material minimizing or avoiding the generation of oxygen, chlorine gas and/or the anodic oxidation of P-bearing ions in the electrolyte.

Selective and brush plating methods are used, e.g., to repair damaged components in-situ by electroplating on a limited area instead of immersing entire components into plating bath, which results in remarkable savings of cost and man-power. With the recent commercial introduction of various nanocrystalline materials in the form of homogenous coatings, graded coatings or multi-layer laminate coatings by Integran Technologies Inc., of Toronto, Canada, the assignee of the present application, selective plating processes are required for, among other, field repair purpose of fine-grained materials.

As highlighted above when employing non cumsumbale, dimensionaly stable anodes (DSAs), the anode reactions do not liberate metal ions required in the cathodic depostion. Therefore, metal ions for the cathodic reduction must be supplied solely from the electrolyte solution. As metal ions in the electrolyte are consumed during the electrodeposition process, the metal-ions in the electrolyte are depleted and must be replenished. In the case of using DSAs in aqueous electrolytes, the desired anodic reaction is typically oxygen evolution. Depending on the anode material, the electrolyte composition and operating parameters, include, but not limited to, temperature and current density; however, other anodic reactions can take place such as chlorine evolution (from chloride bearing electrolyes) and direct or indirect oxidation of $P^{3+}$-ions or $P^{+}$-ions to phosphate ($P^{5+}$-ions, or the undesired oxidation of metal ions to higher valencies. This makes bath maintenance more complicated unless the depleted electrolyte is discarded, which is costly and generates added hazardous waste. Moreover, using DSAs undesirable chemical species, including but not limited to chlorine gas, may be liberated as a result of the anodic reactions which may represent a health and safety hazard for the operator. The anodic gas release in a compact electrolytic cell design such as employed in brush plating applications is highly undesired.

Efforts to develop commercially viable selective and/or brush plating technologies involving the use of DSA, e.g., for P-containing Co deposits, result in a rapid deterioration of the plating solution and the coating quality. Specifically, using conventional brush plating tools with DSAs with chloride and sulfate based electrolytes for depositing Co—P based coatings, the following problems were noted:

a. Rapid decrease of the $Co^{2+}$ concentration and the pH in electrolyte, necessitating frequent addition of $CoCO_3$;
b. Significant $Cl_2$ evolution;
c. Rapid drop in deposit P level in the coating with increasing Ah/l electrolyte use requiring frequent (more often than every 10 min) or continuous additions of $H_3PO_3$;
d. Additions of $H_3PO_2$ in addition to $H_3PO_3$ (as $H_3PO_3$ additions alone are not always sufficient to maintain desired P-deposit levels in the coating) to maintain a uniform deposit composition;
e. Increase in solution density which ultimately requires a premature disposal of the solution (approx. between 75 and 150 Ah/l) as the solution becomes too viscous to pump.

Without trying to be bound by the theory, it is believed the main reason for the poor consistency, stability and longevity of brush plating solutions frequently is due to the use of conventional DSAs.

Typical Watts Ni or Co based electrolytes contain chloride ions and, due to the high overpotential for oxygen evolution (~/>0.5V), the anodic reaction is not limited to oxygen generation and, depending on the nature of the DSA and the electrolyte, usually chlorine gas is evolved.

Specific to P containing deposits (Ni—P, Co—P, Fe—P), it is believed chlorine produced on the DSA oxidizes phosphorous ions in the electrolyte or, possibly, phosphorous ions could be oxidized anodically directly, resulting in depletion of phosphorous ions by conversion to phosphoric ions. The result is a rapid local depletion of $P^{+}/P^{3+}$-ions in the "brush electrolyte solution" causing a commensurate reduction of the P content in the coating and solution longevity and stability issues.

The inventors have surprisingly discovered that dimensionally stable, consumable anodes (DSSAs) provide a viable approach for brush plating when using electrolytes containing chlorides and/or $H_3PO_2$ and $H_3PO_3$ and/or metal ions which can be anodically oxidized. Without considering overpotentials for specific anodic reactions, it is apparent that in the case of plating Ni or Co from chloride containing electrolytes a change in the anodic reaction from $O_2/Cl_2$ evolution to Co or Ni dissolution lowers the anodic potential and reduces the cell voltage by >1.5V.

Benefits of employing consumable anodes for use in brush plating include (i) lower operating cell voltages and reduced power consumption, (ii) increased worker health/safety by avoiding toxic gas evolution, (iii) simpler bath management enabling electrolytes to be used much longer, i.e., increased Ah/l use, (iv) reducing the overall complexity and cost of field repair and, (v) enabling a consistent and uniform cathodic deposit.

The inventive concept is based on converting/retrofitting DSA brush anode applicators to dimensionally stable, high surface area soluble/consumable anodes (DSSAs) by suitably designing brush applicator tools. The conversion entails employing consumable anode inserts with pores and/or voids which provide for: (i) a high active interface surface area anode (active anode surface area/anode cathode interface area ≥1, preferably ≥2) while (ii) providing for relatively unimpeded and sufficiently high electrolyte flow; (iii) maintaining the physical shape and/or integrity of the consumable anode insert despite the anodic dissolution of metal ions; (iv) achieving uniform anodic dissolution; and (v) avoiding significant anode size changes and clogging of the absorber by powders or dislodged active anode fragments. A further benefit is to be able to replace and/or replenish consumable anode inserts conveniently to restore or replenish the "anode capacity" without having to dispose of the anode applicator.

These objectives can be accomplished by creating, e.g., an anode cavity in a brush plating applicator as illustrated in FIG. 1 filled with suitable anode rounds (pellets, flakes, etc.) that can be held together by a suitable binder or electrolyte pervious anode inserts such as open cell foams or perforated plates that have been plated with the desired metal or alloy, e.g., Ni, Co, Fe and Cu.

Suitable consumable anode inserts comprising, e.g., Ni, Co, Fe or Cu of desired size and shape can be conveniently prepared by any well-known metal deposition process. Grain-refined and/or amorphous consumable anode active material layers are particularly desirable as fine-grained and amorphous layers typically anodically dissolve more uniform than coarse-grained materials. Open cell foam or other solid porous bodies enabling unrestricted electrolyte flow throughout can be pre-plated with the desired metals and or replenished in a conventional tank plating set up.

Electroplating/Electroforming Description:

A person skilled in the art of plating will know how to generally electrodeposit selected coarse-grained, fine-grained and/or amorphous metals, alloys or metal matrix composites choosing suitable plating bath formulations and plating conditions as described in US 2005/0205425 and US 2010/0304172, both assigned to the same assignee as the present application.

The prior art describes that dimensionally stable anodes (DSA) or consumable anodes (SA) can be used interchangeably in electrodeposition. Suitable DSAs include platinized metal anodes, platinum clad niobium anodes, graphite or lead anodes or the like. Consumable anodes include metal or alloy rounds, chips and the like, e.g., placed in a suitable anode basket made out of, e.g., Ti, and preferably covered by suitable anode bags.

As highlighted in the objectives, when using dimensionally-stable, consumable anodes, metal-ions lost from the electrolyte through reduction to the coating on the cathode get constantly replenished by anodically dissolving the same metal or alloy. Further benefits of using dimensionally-stable, consumable anodes include a substantial reduction in the cell voltage due to the potential difference between metal-oxidation and oxygen evolution and much simpler bath maintenance. Consumable anodes employed in a confined space using moving electrodes need to be insensitive to the position of space, i.e., consumable anodes can be operated in all three-dimensions of space including "upside down".

When using consumable anodes in tank plating set-ups, metal-ion depletion in the electrolyte is prevented by using metal rounds as consumable "stationary" anodes, alternatively metal-ion depletion is prevented by suitable bath additions. The addition of "rounds" or other loose "anode fragments" is desired, as this is (i) a convenient way of adding/topping up the active anode, (ii) the anode "settles" with increased use through gravity so the "anode level" can easily be monitored and (iii) electrical contact between the individual pieces is maintained by the anodes own weight and gravity as the anode is stationary, i.e., it doesn't change its position during the plating operation.

In the case of brush plating, however, the anode is not stationary and it needs to follow the contours of, at times, complex workpieces. Brush plating applicators need to be operated horizontally, vertically as well as upside down, i.e., they need to be insensitive to orientation. Therefore consumable anode cages employing anode rounds which settle due to gravity as they are being used in tank plating are not suitable. Low surface area anode plates can passivate and, while being amenable to selective plating, cannot be easily used in typical brush plating set ups which requires the electrolyte to be circulated through the brush applicator. Brush applicators furthermore need to be compact and robust as in a number of applications, including, but not limited to field repair; they are simply moved back and forth over the workpiece by hand by an operator.

The anode brush system, which is typically portable, comprises the anode brush applicator, suitable piping to provide electrolyte from a reservoir that contains a heating system and a filter, and an electrolyte collection system which gathers the electrolyte exiting the anode applicator after contacting the workpiece. After the system is set up, rendered operational and suitably contacts the appropriately activated workpiece(s), direct or pulsed current (including the use of one or more cathodic pulses, and optionally anodic pulses and/or off times) is applied between the cathode(s) and the anode(s). A suitable duty cycle is in the range of 10% to 100%, preferably between 50 and 100% and suitable applied average cathodic current densities are in the range of 25 to 2,500 mA/cm$^2$, preferably between about 100 and 1,000 mA/cm$^2$. As the person skilled in the art knows, the microstructure (crystalline or amorphous deposits) of the cathodic coating can furthermore be affected by a number of variables including, but not limited to, the bath chemistry, the electrical wave forms, cathode surface flow conditions and bath temperature. As desired, homogenous, layered and/or graded cathodic deposits can be prepared using the DSSAs described herein.

As indicated above active anode brush applicator inserts according to the present invention are sufficiently permeable to the electrolyte and contain significant void space to enable a relatively unimpeded electrolyte flow through the electrochemically active anode structure. The porosity of the anode inserts should be maintained above 10%, preferably above 25%.

As indicated, powder, flakes, junks and the like, i.e., loose aggregates of the consumable anode material(s) can, in principal, be used for the electrochemically active anode structure/anode inserts. The disadvantage of this approach relates to electrical contact issues as the volume/weight of the consumable anode declines with increased use, accompanied with a change in the electrolyte permeability and the concerns associated with releasing fine powder into the electrolyte solution and/or the puncture of the absorber leading to short circuits. Suitable binders can be employed to convert loose aggregates into a rigid structure, as highlighted. Alternatively, the loose aggregate containing soluble anode inserts are not utilized to exhaustion, e.g., not more than 75$^{wt}$%, preferably not more than 50$^{wt}$% and even more preferably not more than up to 25$^{wt}$% of the anode material is consumed in the anodic reaction before the soluble anode insert is replaced, replenished, and/or the fines are removed and the anode insert is repacked to account for the mass and volume loss and ensure good electrical contact.

According to one embodiment of the present disclosure, the active consumable anode material(s) is/are deposited on a permanent substrate which does not act as an electrochemically active anode structure at the plating conditions used. In this case, while the weight of the anode drops with increased usage, the overall volume and electrolyte permeability remains relatively unchanged as the electrochemically active consumable anode layer dissolves eventually exposing the underlying permanent substrate. This approach assures fairly uniform plating conditions until substantially all electrochemically active anode structure(s) is/are consumed assuring a uniform cathodic deposit throughout the consumable anode insert life.

According to one embodiment of the present disclosure, the permanent anode substrate can be electrically conductive which is desired as the Ohmic drop with increased anode usage is minimized. However, depending on the nature of the electroplating bath and plating conditions it may be challenging to find an electrically conductive permanent, however, electrochemically inactive material. As highlighted, chloride containing electrolytes, C-containing substrates (carbon, graphite, carbon nanotubes, graphene) are therefore undesired. Electrochemically inert metals/alloys are preferred for use as permanent substrates. Alternatively, electrically conductive, yet electrochemically inert substrates can also include oxides such as, e.g., Ti-suboxides of the Magnéli phases ($Ti_nO_{2n-1}$, n=5-6). In yet another embodiment, polymeric substrates are chosen, which could optionally be rendered electrically conductive through the employ of conductive filler materials.

FIG. 1 shows a cross sectional view of one embodiment of a brush plating apparatus according to the present disclosure. A workpiece 10 (i.e., cathode) to be plated is connected to the negative outlet of a power source 12. An anode brush applicator 14 includes a handle 16 and an at least partially conductive anode brush housing 18 connected to the handle. The conductive anode brush housing 18 houses a consumable anode insert 20 in an anode cavity 22. The consumable anode insert 20 preferably includes a permanent, electrochemically inert, electrolyte pervious substrate and a sacrificial anode metallic coating/layer provided on the permanent substrate and having a thickness between 1 μm and 5 cm. The sacrificial anode metallic coating/layer is an active consumable anode material capable of being anodically dissolved when current is supplied to the apparatus. The consumable anode insert 20 defines an anode surface area, and reference numeral 24 depicts an electrode interface area between the anode (i.e. the anode brush applicator 14) and cathode (i.e., the workpiece 10). Alternatively, electrical connections can be provided to connect the power supply to the consumable anode insert. If required, an insulating frame member 30 prevents the conductive anode brush housing 18 from participating in the plating reaction and its frame opening defines the electrolytic interface area 24. An absorbent separator (wick) 32 provides for the electrolyte space between the anode and cathode and enables the continuous electrolyte flow from the consumable anode insert to the workpiece 10. The anode brush housing contains channels 34 for supplying electrolyte solution 36 from (preferably) a temperature controlled tank (not shown) to the consumable anode insert 20. The electrolyte solution dripping from the absorbent separator 32 is optionally collected in a tray 40 and recirculated to the tank. The absorbent separator 32 containing the electrolyte solution 36 also electrically insulates the anode brush housing 18 and the consumable anode insert 20 from the work-piece 10 and adjusts the spacing between the anode (i.e. the anode brush applicator 14) and cathode (i.e., the workpiece 10). The anode brush handle 16 can be moved over the workpiece 10 either manually or using a motorized motion.

Figure 2:
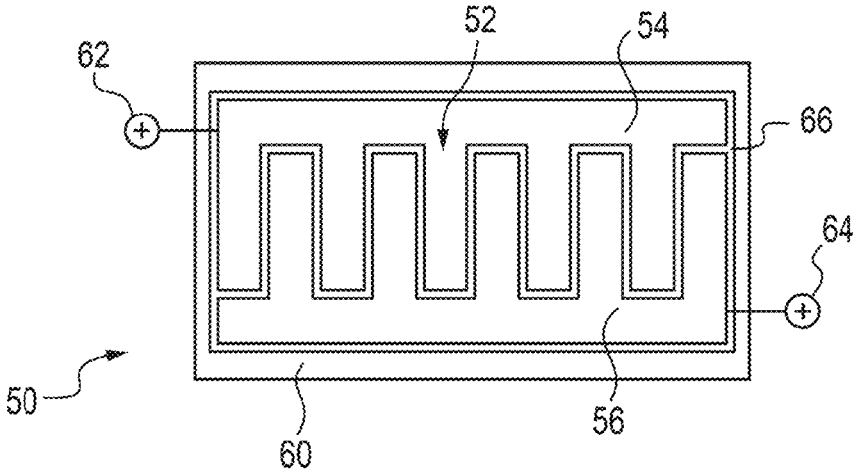
FIG. 2 illustrates an alternative exemplary embodiment of the anode applicator tool.

FIG. 2 schematically shows a frontal view of a brush plating tool 50 comprising another exemplary consumable anode insert 52 according to the present disclosure. The consumable anode insert 52 is designed for use with two consumable anodes. Specifically, the consumable anode insert 52 includes two consumable anodes 54 and 56 provided in a recessed non-conductive housing 60. The electrolyte pervious, consumable anode 54 containing a consumable metal $M_1$ deposited on a suitable substrate $S_1$ is connected to a power supply (not shown) via electrical contact 62. The electrolyte pervious, consumable anode 56 containing a consumable metal $M_2$ deposited on a suitable substrate $S_2$ is connected to another power supply (not shown) via electrical contact 64. The electrolyte pervious, consumable anodes 54 and 56 have a generally comb type design/configuration relative to each, cover a significant portion of the total anode area, and are physically separated by a spacer, separator, or equivalent depicted at reference numeral 66. The electrolyte pervious, consumable anodes 54 and 56 are electrically isolated from each other to enable to direct the desired anodic current $A_1$ and $A_2$, to the consumable anodes 54 and 56 from their respective power supplies. The negative lead of both power supplies is connected to the workpiece and the individual anodic currents are regulated to achieve the desired dissolution rates of metal $M_1$ and $M_2$. The brush plating tool 50 is wrapped in a suitable absorber and enables the continuous electrolyte flow from the consumable anode insert 52 to a workpiece (not shown).

The electrolyte used can be temperature controlled and passed through the anode applicator tool to maintain the desired temperature range. The absorbent separator material contains and distributes the electrolyte solution between the anode and the workpiece (cathode), prevents shorts between anode and cathode and brushes against the surface of the area being plated. It is believed that the mechanical rubbing or brushing motion imparted to the workpiece during the plating process influences the quality and the surface finish of the coating and enables fast plating rates. Selective plating electrolytes are formulated to produce acceptable coatings in a wide temperature range from as low as −20° C. to 95° C. As the workpiece is frequently large in comparison to the area being coated, selective plating is often applied to the workpiece at ambient temperatures, ranging from as low as −20° C. to as high as 45° C. Unlike "typical" electroplating operations, in the case of selective plating the temperature of the anode, cathode and electrolyte can vary substantially. Salting out of electrolyte constituents can occur at low temperatures and the electrolyte may have to be periodically or continuously reheated to dissolve all precipitated chemicals.

The following working examples illustrate the benefits of the present disclosure, specifically polarization curves obtained with brush plating CoP deposits using DSA and SA (Working Example 1); CoP deposits prepared using DSA and several SA under various conditions (Working Examples 2, 3 and 4), polarization curves obtained with brush plating Ni—P deposits using DSSA and SA (Working Example 5); polarization curves obtained with brush plating Fe deposits using DSSA and SA (Working Example 6); nanocrystalline Fe deposits prepared using DSSA and SA (Working Example 7); and nanocrystalline Ni—Fe deposits prepared using DSSA and SAs (Working Example 8).

EXAMPLE 1

Co Plating, Polarization Curves DSA, DSSA

A brush plating applicator was built and operated as illustrated in FIG. 1. Specifically, a brush plating applicator (model 3030-30$A_{max}$) from Sifco Industries Inc. (Cleveland, Ohio, USA) was suitably modified as described above. More specifically, the graphite anode applicator was modified to enable the use of DSSA or SA inserts. The brush plating applicator contained an active anode cavity having an interfacial area of up to 21 $cm^2$ and a depth of 5 mm machined into a graphite anode tool housing which provided for electrolyte feed channels and electrical contact and served as current collector for the active anode insert. A cotton absorber was placed over the brush applicator containing the anode insert. The absorber also served as electrolyte spacer and provided a gap between the anode and cathode of ~1 mm.

A plating solution was pumped into the modified anode brush applicator and exited through the anode inserts and the absorber onto a workpiece to be plated. The electrolyte dripping from the workpiece was collected in the temperature-controlled tank and re-circulated to the modified anode brush applicator and the anode inserts via a peristaltic pump. The temperature in the tank was adjusted as required, and the temperature measurements reported were taken on the electrolyte flowing/dripping from the workpiece. The total electrolyte solution for all trials was 1.7 liters and the electrolyte was circulated at a flow rate of 300 ml/min.

The modified anode brush plating applicator was attached to and operated by a mechanical arm available from Sifco Industries Inc. (Cleveland, Ohio, USA) at 50 strokes per minute as set forth in US 2005/0205425, which is assigned to the same assignee as the present application. The rotation speed was adjusted to increase or decrease the relative anode/cathode stroke-speed. Electrical contacts were made on the brush handle (anode) and directly on the workpiece (cathode).

The workpiece was a mild steel plate and a commercial chloride-based electrolyte for depositing fine-grained Co—P alloys (available from Integran Technologies Inc., Toronto, Ontario, Canada, the assignee of the present application) containing $H_3PO_3$ as the P source was used. The workpiece was a 10×20 cm mild steel plate that was suitably activated before the plating commenced.

In this working example, DSA and Co-based consumable anode inserts (DSSA) with 5 $cm^2$ interfacial area were employed and polarization curves measured using the Internal Resistance Free Measuring System IRF-PS155AL available from Rosecreek Technologies Inc. (Mississauga, Canada), which applies the well-known current interruption techniques described in U.S. Pat. No. 2,662,211. This measuring technique eliminates the resistive component of electrochemical cells and their components and enables the measurement of the electrochemical cell voltages and potential(s). The IRF measurement technique uses brief current interruption to eliminate Ohmic losses from the circuit. The time constant for the electrical resistance, capacitance and inductance of the conductors, electrodes, and electrolyte is typically in the range of microseconds whereas transients relating to the electrochemical polarization (concentration polarization, transport phenomena, etc.) are much slower, with time constants typically in the range of at least 100 millisecond.

Polarization curves were obtained at temperatures between 20° C. and 80° C. in 20° C. intervals with an open-cell graphite-DSA and a dimensionally stable, consumable Co anode insert (Co coating on a polyurethane open cell foam) at current densities between 0 and 1,000 mA/$cm^2$. The hardness of consumable Co anode layers was 387±33 VHN (average grain size: 70 nm) as compared to Inco electrolytic Co rounds employed in tank plating which have a hardness of 230VHN (average grain size ~5 microns). Table 1.1 highlights the applied cell voltages at four temperatures and three current densities for dimensionally stable and consumable anode inserts. The significantly reduction in applied cell voltage when employing fine-grained Co-consumable anodes is evident. Table 1.1 also expresses the flow rates in terms of ml/min normalized for anode-cathode geometrical interface area; ml/min normalized for applied average current; and ml/min normalized for the applied current density (in mA/$cm^2$).

TABLE 1.1

| | | Current Density [mA/$cm^2$] | | |
|---|---|---|---|---|
| | | 100 | 500 | 1,000 |
| 20° C. | DSA Voltage [V] | 3.0 | 6.0 | 10.0 |
| | DSSA Voltage [V] | 1.6 | 4.7 | 8.1 |
| 40° C. | DSA Voltage [V] | 2.6 | 5.7 | 8.2 |
| | DSSA Voltage [V] | 1.3 | 3.5 | 5.7 |
| 60° C. | DSA Voltage [V] | 2.3 | 4.0 | 6.1 |
| | DSSA Voltage [V] | 1.1 | 2.9 | 4.6 |
| 80° C. | DSA Voltage [V] | 2.3 | 4.2 | 6.2 |
| | DSSA Voltage [V] | 1.1 | 2.8 | 4.5 |
| Flow Rates | [ml/(min · $cm^2$-Interface area)] | 60.0 | 60.0 | 60.0 |
| | [ml/(min · $A_{av}$)] | 600.0 | 120.0 | 60.0 |
| | [(ml · $cm^2$)/(min · $A_{av}$)] | 3,000.0 | 600.0 | 300.0 |

Figure 3:
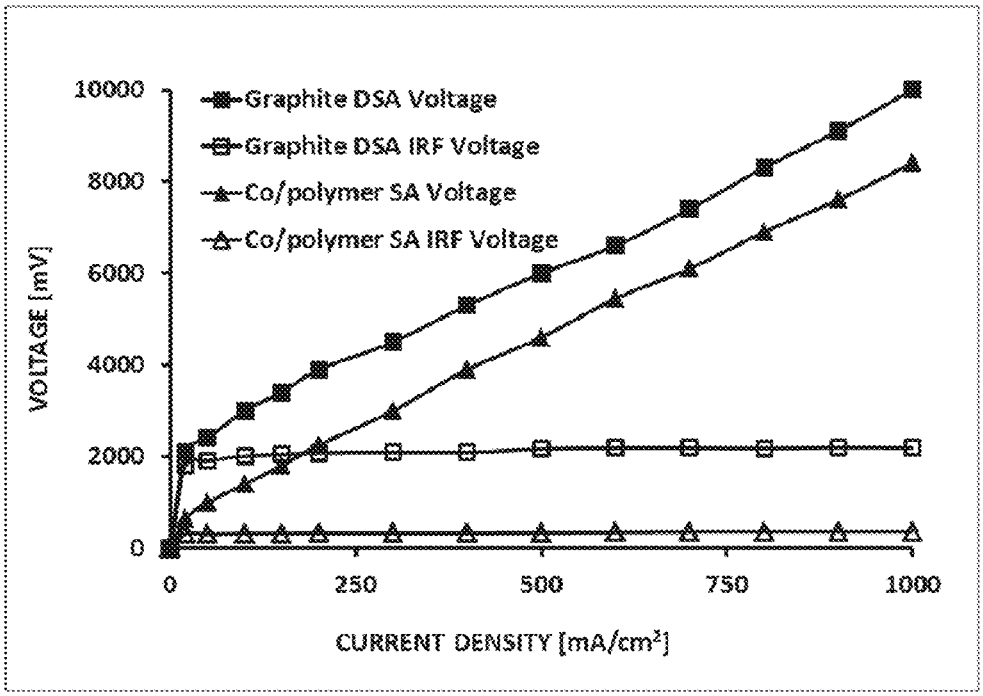
FIG. 3 illustrates polarization curves (cell voltages and IRF-cell voltages) for the cathodic electrodeposition of Co—P alloys using DSAs and Co—SAs.

FIG. 3 shows the polarization curves obtained at 20° C. for the DSA and consumable anodes (DSSA) between 0 and 1,000 mA/$cm^2$. Applied cell voltages as well as IR-free cell voltages are displayed. Again, the significant reduction in applied cell voltage when employing Co-consumable anodes is evident.

EXAMPLE 2

Co Plating, Voltage with Increased Plating Time DSA, DSSA

Figure 4:
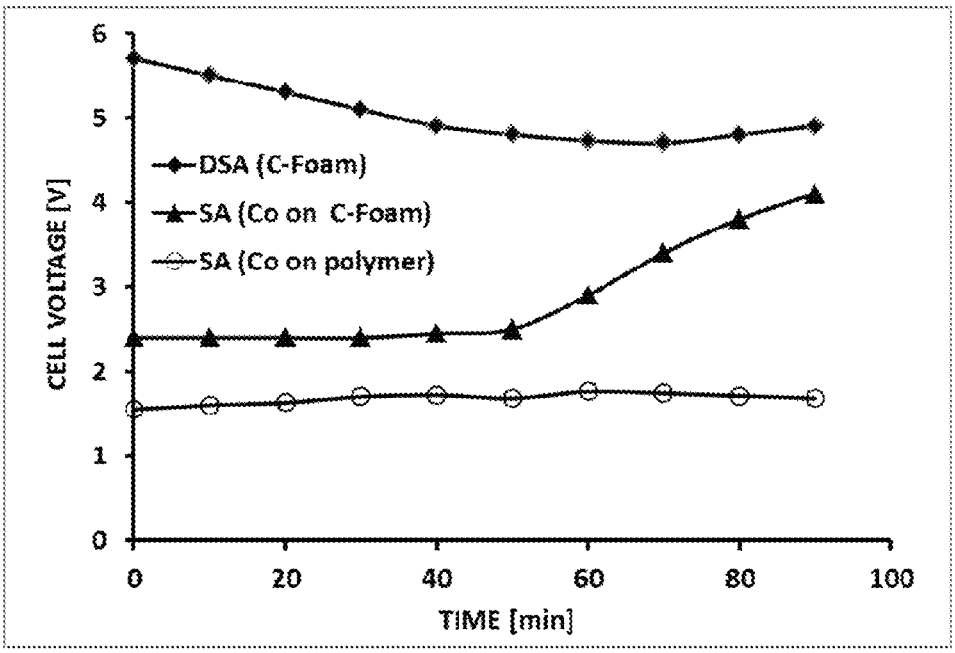
FIG. 4 illustrates cell voltages versus time for the cathodic electrodeposition of Co—P alloys using three different anodes.

For Example 2, the plating set up and conditions described Example 1 were used. The workpiece was a mild steel plate. The electrolyte was preheated to 80° C. The total electrolyte solution for all trials was 1.7 liters and the electrolyte was circulated at a flow rate of 300 ml/min. The anode inserts had an effective interfacial area of 21 $cm^2$ and the current density applied was 150 mA/$cm^2$. DSA and Co-based consumable anodes (DSSA) were employed while electrodepositing CoP as in Example 1 for 90 minutes. FIG. 4 shows the graph for the DSA and two DSSAs (one using Co on a graphite foam substrate and the other one using Co on a polymer foam substrate). FIG. 4 indicates that the applied cell voltage for DSAs was between 5 and 6V, whereas the applied cell voltage for Co-DSSA inserts on a polymer substrate was ~1.5V. Co-DSSA inserts using Co deposited on graphite foam initially had a low applied cell voltage which, after about 45 minutes of plating, increased from ~2.5V to ~4.5V indicating that anodic Co dissolution could not be maintained as the only anodic reaction. Evolution of chlorine gas became evident and it is believed that it coincided with the dissolution of the Co close to the absorber interface and, as soon as the graphite foam became exposed, chlorine evolution took place as well. Table 2.1 illustrates the various flow parameters of interest.

TABLE 2.1

| | |
|---|---|
| Current Density [mA/cm$^2$] | 150.0 |
| Electrolyte Flow Rate through the Anode [ml/min] | 300.0 |
| Anode Flow Rate Normalized for Interface Area [ml/(min · cm$^2$)] = [cm/min] | 14.29 |
| Anode Flow Rate Normalized for Applied Current [ml/(min · $A_{av}$)] | 95.24 |
| Anode Flow Rate Normalized for Applied Average Current Density [(ml · cm$^2$)/(min · $A_{av}$)] = [cm$^5$/(min · $A_{av}$)] | 2.0 |

EXAMPLE 3

CoP Plating, Loss of $H_3PO_3$

For Example 3, the plating set up and plating conditions described in Example 2 were used including a commercial electrolyte for depositing fine-grained Co—P alloys available from Integran Technologies Inc. (Toronto, Ontario, Canada) containing $H_3PO_3$ as the P source. The workpiece was a mild steel plate. The anode inserts had an effective interfacial area of 21 cm$^2$ and the average current density applied was 150 mA/cm$^2$ (300 mA/cm$^2$ peak, 50% duty cycle) and the electrolyte was preheated to 80° C. and circulated through the anode at 300 ml/min; the resulting deposit thickness was ~280 microns.

The $H_3PO_3$ concentration in the electrolyte was determined analytically and the drop in $H_3PO_3$ after 4.73 Ah of plating is displayed in Table 3.1. The data indicate that, with the exception of the consumable Co anode on a polymer foam carrier (average grain size 70 nm, 388 VHN), the $H_3PO_3$ loss experienced was higher than expected when the consumable Co anode used a carbon-graphite substrate and the highest when a graphite DSA was used. The two electrodes experiencing the high $H_3PO_3$ loss also anodically generated chlorine gas. While anodic $Cl_2$ gas evolution was expected for the graphite-DSA, it was somewhat surprising in the case of the Co on graphite anode insert. It was noticed, however, that the Co is preferentially dissolved close to the work-piece/absorber/anode interface, and, as soon as any graphite substrate is exposed, the anodic reaction was not limited to Co oxidation but included $Cl_2$ evolution as well.

TABLE 3.1

| Active Anode: | Open Cell Graphite Foam (DSA) | Co layer on Open Cell Graphite Foam (DSSA) | Co layer on Perforated Polymer (DSSA) | Expected $H_3PO_3$ loss based on P content in the coating |
|---|---|---|---|---|
| Loss of $H_3PO_3$ concentration in the electrolyte after 4.73 Ah of plating [%] | 35.7 | 11.9 | 4.8 | 4.6 |

In addition the cathodically deposited coating was characterized at three locations throughout the deposit thickness, namely the base (directly adjacent to the substrate), the center of the coating, and the outside surface (top). Table 3.2 provides data on cell voltages and coating characteristics for various active anode materials. The results highlight that the most uniform coating is achieved with consumable anodes according to the present invention.

TABLE 3.2

| | | Coating Base | Coating Center | Coating Outer Surface |
|---|---|---|---|---|
| Graphite Open Cell Foam DSA (prior art) | Cell Voltage [V] | 5.7 | 4.9 | 4.8 |
| | Coating P [%] | 1.41 | 1.23 | 1.12 |
| | VHN | 525 | 496 | 485 |
| DSSA: Co on Graphite-Open Cell Foam (80° C.) | Cell Voltage [V] | 2.5 | 2.5 | 3.5 |
| | Coating P [%] | 1.43 | 1.36 | 1.31 |
| | VHN | 532 | 531 | 525 |
| DSSA: Co on Perforated Polymer Plate (this invention) | Cell Voltage [V] | 2 | 2 | 2 |
| | Coating P [%] | 1.40 | 1.41 | 1.39 |
| | VHN | 532 | 531 | 531 |

Similar results are obtained when using Ni and/or Fe based electrolytes as well as for any other P-bearing alloys.

EXAMPLE 4

CoP Plating: Deposit Properties as Function of the Pump Speed @ 150 mA/Cm$^2$ For Example 4, the plating set up and conditions described in Example 3 were used including a commercial electrolyte for depositing fine-grained Co—P alloys available from Integran Technologies Inc. (Toronto, Ontario, Canada) containing $H_3PO_3$ as the P source was used. The workpiece was a mild steel plate. The consumable anode inserts comprised a layer of Co on a perforated polymer (Nylon) plate and had an effective interfacial area of 21 cm$^2$. The Co layer in the consumable anode (DSSA) had a hardness of 387±33 VHN and an average grain size of 70 nm. The average current density applied in all trials was 150 mA/cm$^2$ @ 80° C. and the plating time was 90 minutes. The total electrolyte solution for all trials was 1.7 liters and the electrolyte was circulated through the SA at various flow rates as indicated in Table 4.1 which displays selected cathodic deposit properties as function of the electrolyte flow rate through the consumable anode.

The data indicate that flow rates through anode ≥150 ml/min produced the cathodic deposits consistent with tank plating deposits (1.5±0.5% P, 540±25VHN). At a flow rate through the anode of ~75 ml/min a coherent deposit was formed, however, the initial P content was only 0.9% and it dropped to ~0.1% over the 90 minutes the plating took place. For flow rates at or under 37.5 ml/min no coherent deposit was even formed. The surface of the steel substrate after the "plating" appeared black and grey and no significant visible deposit was noticed in the cross-section. Flakes were noted during these runs to come off the surface and be brushed away by the motion of the anode applicator.

This experiment reveals the importance of the anode design and anode flow rate through the DSSA insert to achieve similar deposits as obtained in tank plating in the presence of a large excess of electrolyte.

TABLE 4.1

| Anode Flow Rate [ml/min] | Anode Flow Rate [ml/(min · cm² interfacial area)] | Anode Flow Rate [ml/(min · $A_{av}$)] | Anode Flow Rate [cm³/(min · $A_{av}$)] | Coating P [%] (Start/End) | Hardness [VHN] (start/End) |
|---|---|---|---|---|---|
| 1.65 | 0.08 | 0.524 | 2.75 | N/A - No coherent deposit | N/A |
| 16.5 | 0.79 | 5.24 | 27.5 | N/A - No coherent deposit | N/A |
| 37.5 | 1.80 | 11.90 | 62.5 | N/A - No coherent deposit | N/A |
| 75 | 3.59 | 23.81 | 125 | 0.90/0.13 | 410/387 |
| 150 | 7.18 | 47.62 | 250.0 | 1.43/1.39 | 540/536 |
| 300 | 14.29 | 95.24 | 500.0 | 1.40/1.39 | 532/531 |

Similar results are obtained when using Ni and/or Fe based electrolytes as well as for any other P-bearing alloys.

EXAMPLE 5

NiP Plating, Polarization Curves DSA, DSSA

Figure 5:
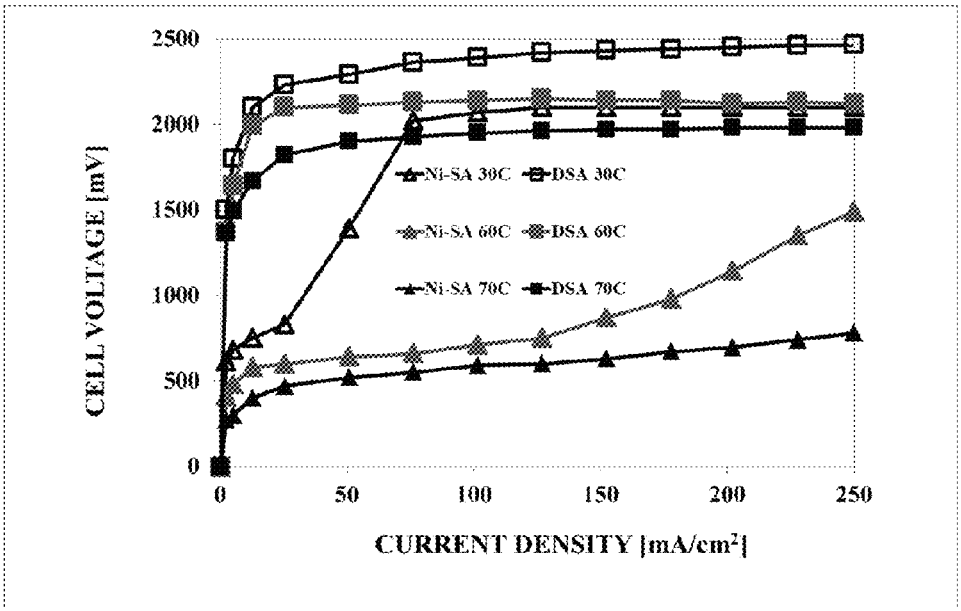
FIG. 5 illustrates IR-corrected polarization curves for the cathodic electrodeposition of Ni—P alloys using DSAs and Ni—SAs at 30° C., 60° C. and 70° C.

For Example 5, the plating hardware described in Example 1 was used. The workpiece was a mild steel plate. The anode inserts had an effective interfacial area of 19.7 $cm^2$. DSA and Ni—S based consumable anodes (DSSA) were employed. Open cell graphite foam was used as DSAs and perforated Ni plates (~250 ppm S, 275 VHN, ratio of total area/interfacial area ~1) were used as consumable anodes. The electrolyte flow through the anodes was 300 ml/min and the mechanical arm was operated at 50 strokes per minute. Polarization curves were obtained using the Internal Resistance Free Measuring System IRF-PS155AL available from Rosecreek Technologies Inc. (Mississauga, Canada). FIG. 5 illustrates the IR-free cell voltages for DSA and SA at 30° C., 60° C. and 70° C., respectively. As expected, the anodic reaction for DSAs is oxygen evolution. The polarization curve at 30° C. indicates that consumable Ni anodes at low current densities (<25 mA/$cm^2$) anodically oxidize and dissolve Ni, at current densities between 25 and 75 mA/$cm^2$ both Ni oxidation and $O_2$ evolution occur, and finally at current densities >75 mA/$cm^2$ the predominant anodic reaction is oxygen evolution. Raising the operating temperature from 30° C. to 60° C. and 70° C. extends the predominant anodic Ni dissolution range from ~75 mA/$cm^2$ to >250 mA/$cm^2$. The limiting current density for anodic Ni oxidation can be extended by various means including, but not limited to: increasing the temperature, increasing the effective anode surface area, adding S to the Ni anode, increasing the electrolyte flow through the anode and employing an electrolyte not susceptible to Ni passivation such as the employ of chloride-based electrolytes.

1.7 liters of a chloride free electrolyte for Ni was employed with the following composition: 300 g/l $NiSO_4.7H_2O$; 40 g/l $H_3BO_3$; 0.1 g/l $H_3PO_3$; 4 ml/l NPA-91. Electrolyte temperature: 30, 60° C. and 70° C. pH: ~2.5

Extended plating runs were performed as well at 60° C. and 130 mA/$cm^2$ average current density. It was noticed that the P content in brush plated deposits was much higher (up to 5 times) of what was obtained under identical conditions in a tank and the average grain size much smaller. Samples plated using DSA showed a much more pronounced loss of P with increased plating time when compared to deposits plated using DSSA which suggests that direct anodic oxidation of $H_3PO_3$ took place.

EXAMPLE 6

Fe Plating, Polarization Curves DSA, DSSA

Figure 6:
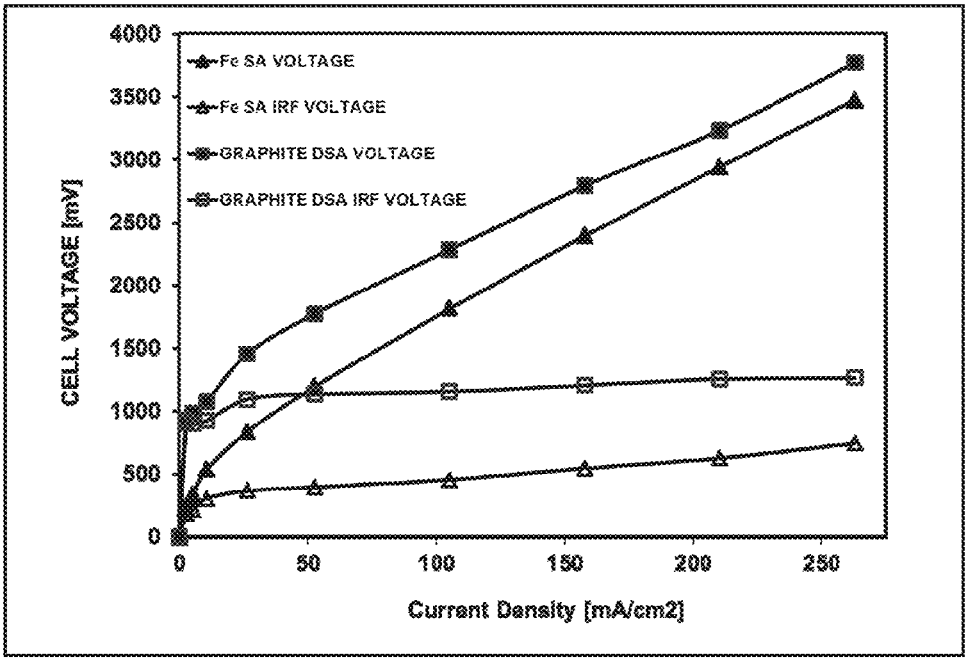
FIG. 6 illustrates polarization curves (cell voltages and IRF-cell voltages) for the cathodic electrodeposition of pure Fe using DSAs and Fe—SAs at room temperature.

For Example 6, the plating hardware described in Example 1 was used. The workpiece was a mild steel plate. The anode inserts had an effective interfacial area of 19 $cm^2$. DSA (perforated graphite plate) and Fe-based consumable anodes (loose Fe chips) were employed. In this experiment no binder was employed in the DSSA as the total amount of Fe anodically dissolved amounted to <10% of the overall active anode material weight. The electrolyte flow through the anodes was 300 ml/min and the mechanical arm was operated at 50 strokes per minute. Polarization curves were obtained using the Internal Resistance Free Measuring System IRF-PS155AL. FIG. 6 illustrates the IR-free cell voltages for DSA and DSSA at 26° C. The anodic reaction on DSAs was predominantly $Fe^{2+}$ oxidation. Using consumable Fe anodes the anodic reaction was the dissolution of Fe.

1.7 liters electrolyte was employed with the following composition: 400 g/l $FeCl_2.4aq$; 70 g/l $AlCl_3.6aq$; 20 g/l $MnCl_2.4aq$. Electrolyte temperature: 26° C. pH: −0.5.

EXAMPLE 7

Fe Plating, Deposit Properties DSA, DSSA

For Example 7, the plating hardware and electrolyte described in Example 6 was used. Fine-grained Fe coatings were deposited at room temperature on mild steel plates using a DSA (graphite foam) or Fe-based consumable anode (electrolytic Fe chips) to a total thickness of ~100 μm. In this experiment, too, no binder was employed in the DSSA as the total amount of Fe anodically dissolved amounted to <10% of the overall active anode material weight. The exposed anode surface area was 12.5 $cm^2$. The electrolyte flow through the anodes was 300 ml/min and the mechanical arm was operated at 50 strokes per minute. Table 7.1 illustrates selected process and coating property information.

TABLE 7.1

| | electrolytic Fe anode (DSSA) | DSA |
|---|---|---|
| Current Density [mA/cm$^2$] | 340 | 340 |
| Cell voltage [V] | 4.3 | 5.4 |
| IRF Cell voltage [V] | 0.58 | 1.35 |
| Cathodic Current Efficiency [%] | 86 | 77 |
| Overall Thickness [μm] | 115 | 97 |
| Plating Time [min] | 19 | 19 |
| Appearance | bright all over | bright with a fringe of dark nodules |
| microcracking density [number per 10,000 μm$^2$] | 110-160 | 90-120 |
| Hardness [VHN] | ≥575 | ≥580 |
| Average Grain Size [nm] | 7 | 8 |

EXAMPLE 8

NiFe Plating, $Fe^{3+}$ Bath Concentration

For Example 8, the plating hardware described in Example 1 was used including a commercial electrolyte for depositing fine-grained Invar alloys available from Integran Technologies Inc. (Toronto, Ontario, Canada). The workpiece was a mild steel plate. The anode inserts had an effective interfacial area of 306 cm$^2$ (7×7"). DSA (perforated graphite plate) and consumable anodes (DSSA) having a consumable Ni-anode section and a consumable Fe-anode section on an open cell polyurethane substrate which were not electrically connected were employed, as indicated in FIG. 2. The Ni and Fe anodes were applied to the foam substrates by electrodeposition, the average grain size for the consumable Ni layer was 20 nm and for the Fe layer 5 μm. The electrolyte flow through the anodes was 20 l/min and the mechanical arm was operated at a stroke speed of 0.17 m/sec. The electrolyte temperature was 55° C. and the applied total average cathodic current density 65 mA/cm$^2$ (70% duty cycle, 100 Hz) using one or two Dynatronix Inc.'s Model PDPR 20-30-100 pulse power supplies (Amery, Wis., USA). In the case of the use of a DSA Ni and Fe ions were continuously replenished by suitable bath additions.

In the case of using consumable anodes, a first power supply provided current to the consumable Ni anode and the steel substrate and a second power supply provided an equal current to the consumable Fe anode section and the cathode. The average Ni-anode current and Fe anode current were kept equal to adjust for the intended deposit composition of Ni-50% Fe. In this case several power supplies are used, the negative leads of all of them are connected to the workpiece to provide the total desired cathode deposition current. The positive lead of each power supply is connected to one of the distinct, electrochemically active consumable anode sections and the individual currents are set and/or regulated to achieve the desired anodic dissolution from each of the distinct segments as desired/required. In the case of alloy deposition, e.g., $Ni_{(1-x)}Fe_x$ alloys the $Ni^{++}$-ion and $Fe^{++}$-ion concentrations in the electrolyte can be maintained at the desired levels by applying (1−x)-fraction of the total current to the consumable Ni anode layer and the remainder, the (x)-fraction of the total current, to the consumable Fe anode layer.

Figure 7:
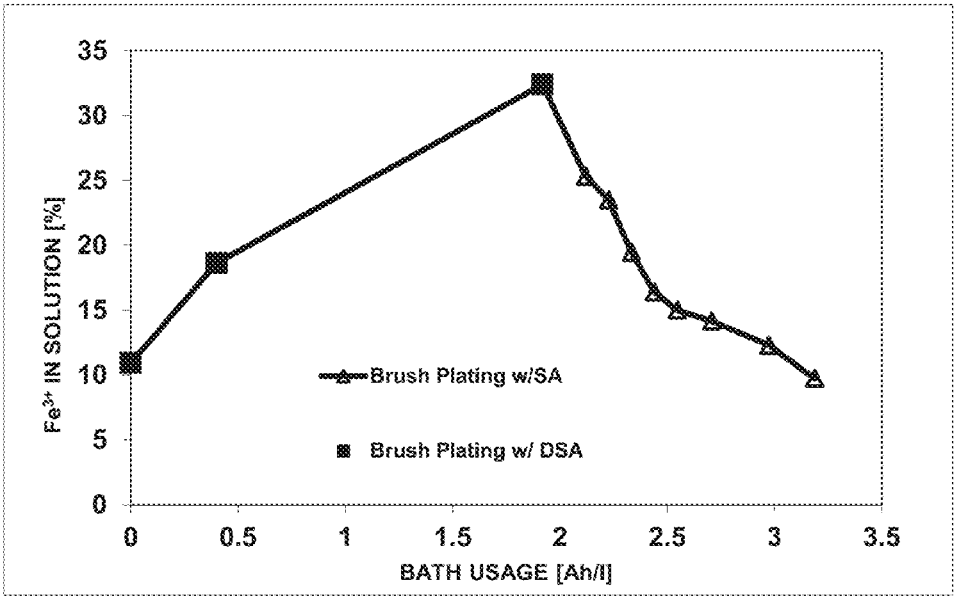
FIG. 7 illustrates the $Fe^{3+}$ concentration in the electrolyte with increased plating time expressed in Ah/l for the cathodic electrodeposition of n-Ni—Fe using a DSA between 0 and about 1.75 Ah/l followed by using dual SAs (Ni-SA and Fe-SA) until ~3.25 Ah/l at 55° C.

FIG. 7 shows the $Fe^{3+}$ concentration in the electrolyte as a function of Ah/l of plating time. Between 0 and 2 Ah/l DSA and suitable $Ni^{++}$ and $Fe^{++}$ ion bath additions were employed, between 2 and 3 Ah/l consumable Ni—Fe anodes without any bath additions were employed. The figure indicates that using DSA the $Fe^{3+}$ concentration in the bath rapidly increases from 10 to 32%. When switching to consumable anodes the $Fe^{3+}$ concentration rapidly drops again illustrating the benefits of using the consumable anode.

The negative impact of the high $Fe^{3+}$ level in the sample made with the DSA was seen in the appearance of the cathodic deposit. The deposit prepared using the prior art DSA was highly stressed and brittle while the deposit produced using consumable anodes (DSSAs) was bright, uniform and ductile.

Based on the teachings provided herein, the person skilled in the art will know how to extend the operation from one consumable anode insert providing one element which anodically dissolves to a consumable anode insert with two or more elements. As highlighted, the electrochemically active consumable anode material can be provided for as alloy, as graded or layered material or, alternatively as highlighted in this example, the consumable anode insert can contain two or more distinct electrochemically active consumable anode material zones which are electrically isolated from each other that can be individually controlled using different power supplies.

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. A method for selectively electrodepositing a coating or a free-standing layer on a workpiece in an electrolytic cell comprising:

moving the workpiece to be coated and an anode applicator tool relative to each other during the electrodeposition process, the anode applicator tool including a consumable active anode insert;

providing a permanent substrate which is electrochemically inert and pervious to the electrodeposition electrolyte and providing a sacrificial anode metallic material coating/layer having a thickness between 1 micron and 5 cm, the permanent substrate together with the sacrificial anode metallic material coating/layer defining the consumable active anode insert;

anodically dissolving a metallic material from the consumable anode insert and cathodically depositing the metallic material on the workpiece;

providing sufficient flow of electrolyte solution through the consumable anode insert to ensure that greater than 90% of the anodic reaction is represented by dissolution of the metallic material;

collecting the electrolyte solution exiting the electrolytic cell and recirculating the collected electrolyte solution through the consumable anode insert;

applying an electric current having a duty cycle between 5% and 100% to the electrolytic cell;

maintaining a concentration of the metallic material being anodically dissolved from the consumable anode insert in the electrolyte solution within ±25% of each Ampere-hour (Ah) per liter of electroplating solution; and creating a cathodic electrodeposit on the workpiece which includes the metallic material anodically dissolved from the consumable anode insert, the chemical composition of the deposit varying by less than 25% in the deposition direction over a selected thickness of up to 25 microns of the deposit, the selected thickness being a portion of the overall deposit thickness in deposition direction.

2. The method of claim 1, further including providing electrolyte flow through the consumable anode insert to ensure that the internal-resistance-free cell voltage is less than 1.2V.

3. The method of claim 1, further including configuring the applicator tool so that the ratio between a surface area of the consumable active anode insert wetted by the electrolyte solution and an interfacial area is greater than or equal to 2.

4. The method of claim 3, further including configuring the applicator tool so that the surface area of the consumable active anode insert wetted by the electrolyte solution is at least 100% greater than the interfacial area.

5. The method of claim 1, further including providing the consumable active anode insert with a porosity greater than or equal to 5%.

6. The method of claim 5, further including providing the consumable active anode insert with a porosity greater than or equal to 25%.

7. The method of claim 1, further including providing the consumable active anode insert devoid of carbon and/or graphite near an interfacial area.

8. The method of claim 1, further including providing the consumable active anode insert with an electrolyte flow rate through the consumable active anode insert of at least 1 ml/min per Ampere applied average anodic current or peak anodic current.

9. The method of claim 1, wherein by modulating the electric current, each of the metallic material layers created on the workpiece has one of a fine-grained microstructure and/or an amorphous microstructure.

10. The method of claim 1, further including providing the consumable active anode insert with a first anode comprising a first metallic material and a second anode comprising a second metallic material, electrically isolating the first metallic material from the second metallic material, and selectively depositing the first metallic material and the second metallic material on the workpiece by applying a first electric current to the first anode and applying a second electric current to the second anode.

11. The method of claim 1, further including positioning an electrically non-conductive, electrodeposition electrolyte pervious absorber between and in intimate contact with both the consumable anode insert and the workpiece.

12. The method of claim 11, further including configuring the applicator tool to be at least partially conductive, and positioning an insulating frame member between the applicator tool and the absorber to prevent the applicator tool from participating in the electrodeposition of the metallic material on the workpiece surface.

13. The method of claim 12, further including configuring the insulating frame member to include a cavity for housing the consumable anode insert, an opening of the cavity defining an electrolytic interfacial area, providing each of the consumable anode insert and the absorber with an electrolyte flow rate therethrough of one of at least 1 ml/min per applied Ampere average anodic current or peak anodic current and at least 1 ml/(min×cm$^2$) interfacial area.

14. The method of claim 1, wherein the metallic material from the consumable anode insert has a fine-grained microstructure and/or an amorphous microstructure.

15. A method for selectively electrodepositing a coating or a free-standing layer on a workpiece in an electrolytic cell comprising:

moving the workpiece to be coated and an anode applicator tool relative to each other during the electrodeposition process, the anode applicator tool including a porous consumable active anode insert comprising a metallic material and having a porosity of at least 5%;

providing a permanent substrate which is electrochemically inert and pervious to the electrodeposition electrolyte and providing a sacrificial anode metallic material coating/layer having a thickness between 1 micron and 5 cm, the permanent substrate together with the sacrificial anode metallic material coating/layer defining the consumable active anode insert; and providing sufficient flow of electrolyte solution through the porous consumable anode insert to ensure that greater than 90% of the anodic reaction is represented by dissolution of the metallic material from the porous consumable anode insert.

16. The method of claim 15, further including positioning an electrically non-conductive, electrodeposition electrolyte pervious absorber between and in intimate contact with both the consumable anode insert and the workpiece.

17. The method of claim 16, further including configuring the applicator tool to be at least partially conductive, and positioning an insulating frame member between the applicator tool and the absorber to prevent the applicator tool from participating in the electrodeposition of the metallic material on the workpiece surface.

18. The method of claim 15, further including providing the consumable active anode insert with an electrolyte flow rate through the consumable active anode insert of at least 1 ml/min per Ampere applied average anodic current or peak anodic current.

19. A method for selectively electrodepositing a coating or a free-standing layer on a workpiece in an electrolytic cell comprising:

moving the workpiece to be coated and an anode applicator tool relative to each other during the electrodeposition process, the anode applicator tool including a porous consumable active anode insert comprising a metallic material and having a porosity of at least 5%;

providing a permanent substrate which is electrochemically inert and pervious to the electrodeposition electrolyte and providing a sacrificial anode metallic material coating/layer having a thickness between 1 micron and 5 cm, the permanent substrate together with the sacrificial anode metallic material coating/layer defining the consumable active anode insert; and providing sufficient flow of an electrolyte solution containing at least one ion selected from the group consisting of chloride-ion, phosphorous-ion and hypophosphorous-ion through the porous consumable anode insert to ensure that greater than 90% of the anodic reaction is represented by dissolution of the metallic material from the porous consumable anode insert.

* * * * *